US005210802A

United States Patent [19]

Aylward

[11] Patent Number: 5,210,802

[45] Date of Patent: May 11, 1993

[54] ACOUSTIC IMAGING

[75] Inventor: J. Richard Aylward, West Newton, Mass.

[73] Assignee: Bose Corporation, Framingham, Mass.

[21] Appl. No.: 516,270

[22] Filed: Apr. 30, 1990

[51] Int. Cl.[5] ..... H04R 3/12

[52] U.S. Cl. ..... 381/61; 381/89; 381/188; 358/335

[58] Field of Search ..... 381/24, 188, 61, 88, 381/89; 358/335; 352/9-11

[56] References Cited

U.S. PATENT DOCUMENTS

| | | | |
|---|---|---|---|
| 3,054,856 | 9/1962 | Arany | 381/89 |
| 3,781,475 | 12/1973 | Sharp | 381/188 |
| 4,230,905 | 10/1980 | Crum et al. | 381/24 |
| 4,256,922 | 3/1981 | Gorike | 381/24 |
| 4,268,719 | 5/1981 | Manger | 381/89 |
| 4,503,553 | 3/1985 | Davis | 381/24 |
| 4,646,349 | 2/1987 | Puls | 381/24 |
| 4,805,221 | 2/1989 | Quaas | 381/90 |
| 4,882,760 | 11/1989 | Yee | 381/89 |

*Primary Examiner*—James L. Dwyer
*Assistant Examiner*—Jack Chiang
*Attorney, Agent, or Firm*—Fish & Richardson

[57] ABSTRACT

An acoustic imaging device includes a support structure and first and second drivers mounted on first and second faces respectively of the support structure. The first driver projects sound output in a first direction, and the second driver projects sound output in a second direction. The sound output of the second driver is out of phase with sound output of the first driver, and is at a level calculated to reduce substantially sound output from the first driver in a direction other than the first direction.

9 Claims, 2 Drawing Sheets

ACOUSTIC IMAGING

The present invention relates in general to speaker systems and more particularly concerns systems that direct acoustic energy in a predetermined direction.

Acoustic drivers typically provide a substantially omnidirectional acoustic output at wavelengths that are substantially greater than the circumference of the driver cone. A listener perceives sound output from such a typical driver as being localized at the driver, regardless of the location of the listener with respect to the driver.

It is an important object of the invention to provide an improved speaker system that provides virtual acoustic imaging.

According to the invention, there is an acoustic imaging device that includes a support structure and first and second drivers mounted on first and second faces respectively of the support structure in fixed relationship therewith. The first driver projects sound output in a first direction, and the second driver projects sound output in a second direction. The sound output of the second driver is out of phase with sound output of the first driver, and is at a level calculated to reduce substantially sound output from the first driver in a direction other than the first direction.

In preferred embodiments, the second direction is directly opposite to the first direction, and the sound output of the second driver substantially reduces sound output from the first driver in the second direction. An electrical network modifies an electrical input signal. The first driver receives the electrical input signal, and the second driver receives a modified electrical signal from the electrical network. The electrical network adjusts the magnitude of the electrical input signal by an amount calculated to cause the second driver to reduce substantially sound output from the first driver in the second direction.

Acoustic imaging devices according to the invention provide substantially directional sound output. If a listener is positioned at a location at which the sound output of the second driver substantially reduces the sound output of the first driver, the listener may perceive sound from the first driver that is reflected from a surface, rather than perceive sound that is localized in the vicinity of the acoustic imaging device itself. Acoustic imaging devices according to the invention can be used in conjunction with visual display systems to create a virtual acoustic image at the location of the visual display, thereby providing close correlation between the locations of visual images and corresponding sounds, and providing plausible center images on the visual display. Acoustic imaging devices according to the invention can also be used to create stereophonic sound systems in a single speaker box.

Numerous other features, objects, and advantages of the invention will become apparent from the following detailed description when read in connection with the accompanying drawings in which.

Figure 1:
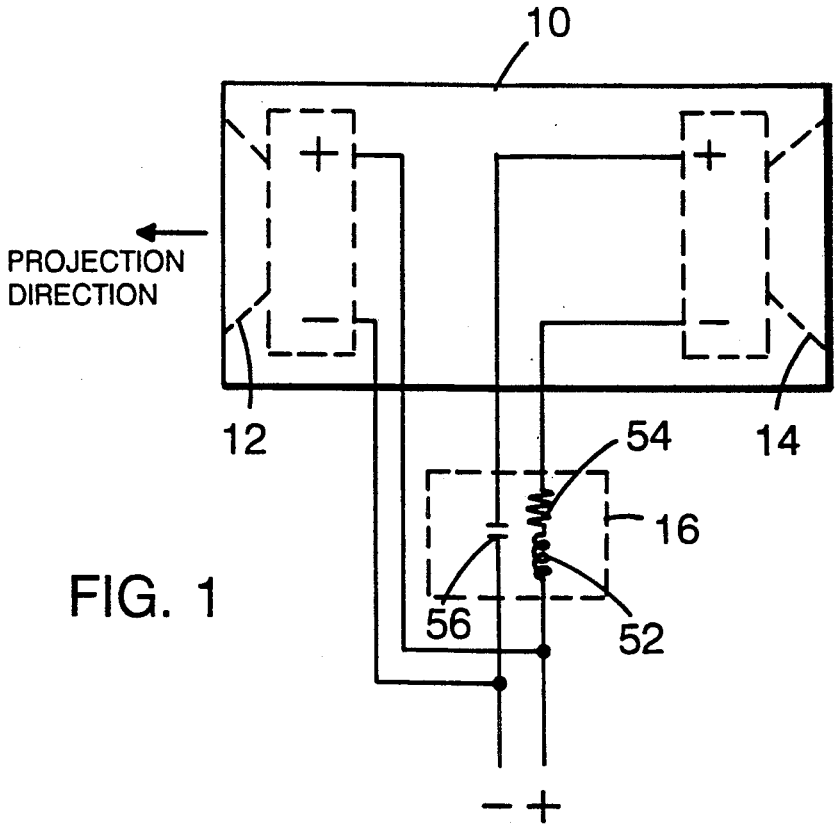
FIG. 1 is a drawing of an acoustic imaging speaker system according to the invention.

With reference now to the drawings and more particularly FIG. thereof, there is shown an acoustic imaging speaker system that includes a small rectangular support structure 10 on which two speaker drivers 12 and 14 are mounted. Speaker drivers 12 and 14 are each omnidirectional at frequencies of about 200 Hz. Speaker drivers 12 and 14 are directed in opposing directions, with driver 12 being directed in the "projection" direction. An electrical input channel provides an electrical input signal to driver 12. An electrical network 16 adjusts the magnitude of the electrical signal, and driver 14 receives the modified signal 180° degrees out of phase with speaker driver 12.

Electrical network 16 is a passive RLC bandpass filter having, in one embodiment, a 2 millihenry choke 52 connected in series with a 2.7 ohm resistor 54 between the positive terminal of the electrical input channel and the negative terminal of driver 14, and a 47 microfarad capacitor 56 connected between the negative terminal of the electrical input channel and the positive terminal of driver 14. With the values stated above, electrical network 16 blocks frequencies below 200 Hz. and above 1.25 kHz. The high-frequency roll-off reduces the sound output of driver 14 at those frequencies at which the sound output of driver 12 is substantially directional. In modifying the amplitude of the electrical input signal, electrical network 16 also modifies somewhat the phase of the electrical input signal, but the phase change is minimal at frequencies well within the bandwidth of electrical network 16 and hence does not have a substantial adverse effect on the performance of the system.

Electrical network 16 adjusts the magnitude of the electrical input signal by a predetermined amount calculated to cause the acoustic output of driver 14 to reduce substantially the acoustic output of driver 12 at locations outside of approximately plus or minus 90 degrees from the direction of projection, but not at locations within approximately plus or minus 90 degrees of the direction of projection. At locations within approximately plus or minus 90 degrees of the direction of propagation. Thus, the speaker system approximates a driver mounted on an infinitely large baffle through which only reflected sound can pass, but through which direct sound from driver 12 can not pass.

Figure 2:
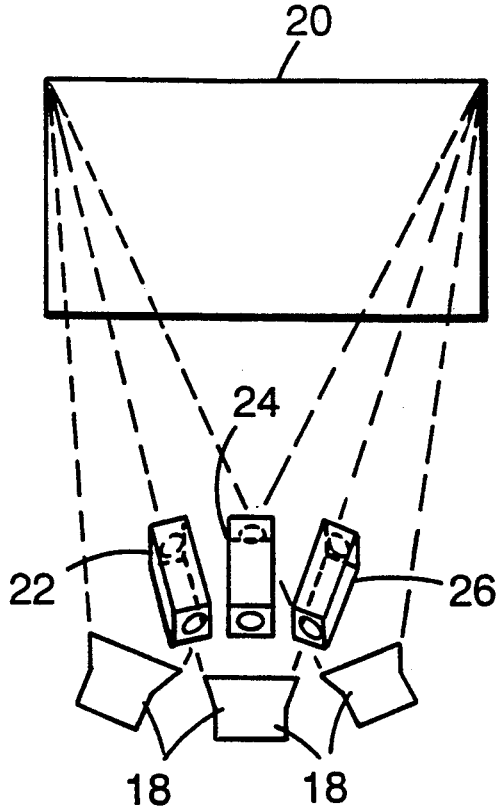
FIG. 2 is a drawing of an audio-visual system that combines visual projection techniques with acoustic imaging techniques according to the invention.

Referring to FIG. 2, there is shown a projection television apparatus that incorporates acoustic imaging speaker systems as described in FIG. 1. The projection television apparatus includes a set of light projectors 18 that project light onto a screen 20 to form a visual image on the screen. Each light projector 18 projects light of a one color only, which is combined with light of other colors from the other light projectors to form a color image. The apparatus also includes a left acoustic imaging speaker system 22 connected to a left channel, a center speaker system 24 connected to a center channel, and a right speaker system 26 connected to a right channel. Speaker systems 22, 24, and 26, which may be mounted on the floor as shown, on the ceiling, or on side walls, project sound output onto screen 20 to form a stereophonic acoustic image on screen 20, which is an acoustically reflective surface. A listener is positioned behind light projectors 18 and speaker systems 22, 24, and 26. Because speaker systems 22, 24, and 26 are constructed to effectively eliminate sound output in directions that are greater than approximately plus or minus 90 degrees away from the direction of propagation, the listener does not localize sound at the speaker systems, but rather perceives sound that appears to emanate from screen 20.

Figure 3:
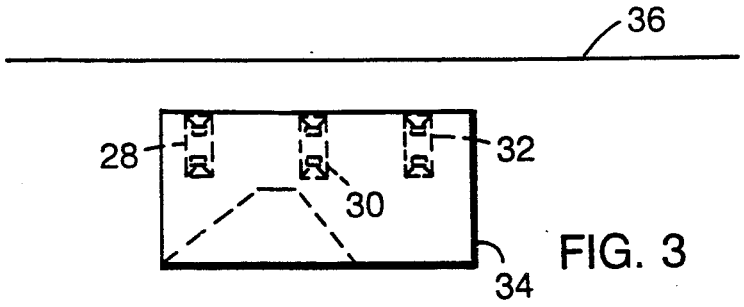
FIG. 3 is a drawing of a television system that incorporates acoustic imaging speaker systems according to the invention, as viewed from above the television system.

Referring to FIG. 3, left channel, center channel, and right channel speaker systems 28, 30, and 32 respectively can be used in conjunction with an ordinary television set 34 to provide a stereophonic acoustic image on a wall 36 located behind the television set. The speaker systems project sound out of the back of television set 34 onto wall 36, which is spaced apart from the television set.

Figure 4:
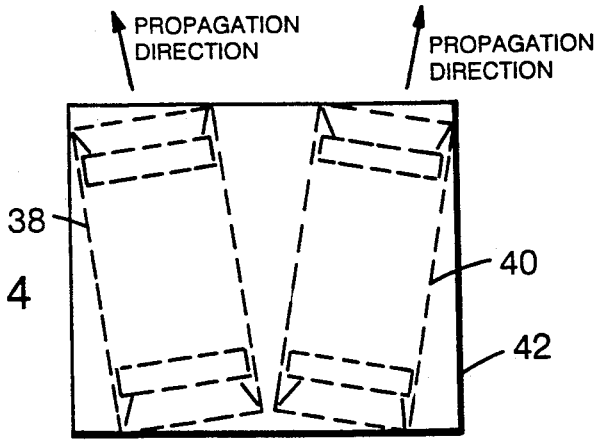
FIG. 4 is a drawing of a stereophonic sound system that incorporates acoustic imaging speaker systems according to the invention.

Referring to FIG. 4, a left channel speaker system 38 and a right channel speaker system 40 can be combined in one speaker box 42 to form a stereophonic sound system. Sound output from left channel speaker system 38 reflects off of a left portion of an acoustically reflective wall, while sound output from right channel speaker system 40 reflects off of a right portion of the wall.

Figure 5:
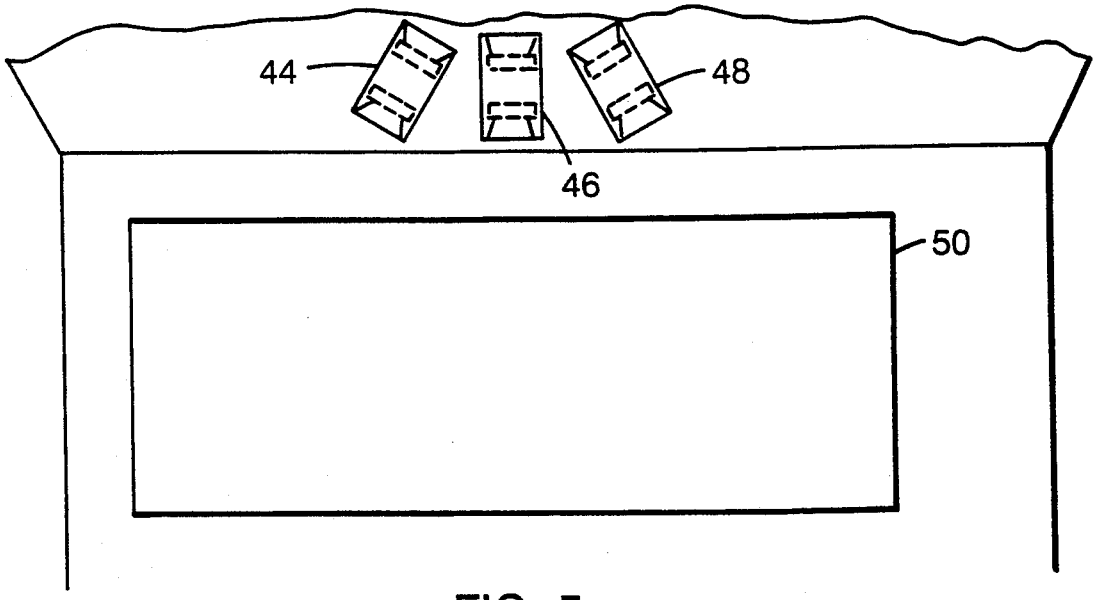
FIG. 5 is a drawing of a high-definition or expanded-definition television system that incorporates acoustic imaging speaker systems according to the invention.

Referring to FIG. 5, a left channel speaker system 44, a center channel speaker system 46, and a right channel speaker system 48 can be used in conjunction with a high-definition or expanded-definition television screen 50 that has an aspect ratio comparable to that of a movie-theatre screen. Screen 50 is wide enough to occupy all of a viewer's peripheral vision when the viewer is positioned at a distance of five to six feet from the screen. Speaker systems 44, 46, and 48 are mounted on a ceiling 52 and project sound at an angle downwards to form an acoustic image on screen 50. Alternatively, the speaker systems may be mounted on side walls or on the floor. In any event, the speaker systems must be mounted such that the listener does not receive sound output directly from the speaker systems themselves, but rather receives only reflected sound output. Thus, the listener perceives a virtual acoustic image that is localized on the screen itself, rather than sound that emanates from locations set apart from the screen. The virtual acoustic image on the screen can also include a plausible center image.

There has been described novel and improved apparatus and techniques for virtual acoustic imaging. It is evident that those skilled in the art may now make numerous uses and modifications of and departures from the specific embodiment described herein without departing from the inventive concept. Consequently, the invention is to be construed as embracing each and every novel feature and novel combination of features present in or possessed by the apparatus and technique herein disclosed and limited solely by the spirit and scope of the appended claims.

What is claimed is:

1. An audio-visual system, comprising an image production device for producing an image on a display surface, and at least one acoustic imaging device for producing a virtual acoustic image on an acoustic image surface, said acoustic imaging device comprising, a support structure, a first driver mounted on a first face of said support structure in fixed relationship therewith, for projecting sound output in a first direction toward said acoustic image surface, and a second driver mounted on a second face of said support structure in fixed relationship therewith, for projecting sound output in a second direction other than said first direction, said sound output of said second driver being substantially 180° out of phase with sound output of said first driver, and being at a level calculated to reduce substantially sound output from said first driver in a direction other than said first direction, wherein said display surface comprises said acoustic image surface.

2. An audio-visual system in accordance with claim 1, wherein said second direction is directly opposite to said first direction, and said sound output of said second driver is at a level calculated to reduce substantially sound output from said first driver in said second direction.

3. An audio-visual system in accordance with claim 1 wherein there are left and right said acoustic imaging devices for producing left channel and right channel virtual acoustic images respectively, said left acoustic imaging device is constructed to direct left channel sound output toward a left portion of said acoustic image surface, and said right acoustic imaging device is constructed to direct right channel sound output toward a right portion of said acoustic image surface, said left channel and right channel virtual acoustic images resulting in a stereophonic acoustic image on said acoustic image surface.

4. An audio-visual system in accordance with claim 3 wherein there is a central said acoustic imaging devices for producing a center channel virtual acoustic image, and said central acoustic imaging device is constructed to direct center channel output toward a central portion of said acoustic image surface.

5. An audio-visual system in accordance with claim 4 wherein said display surface comprises said acoustic image surface.

6. An audio-visual system in accordance with claim 1 wherein said image production device comprises at least one light projector for projecting light onto said display surface, and said acoustic imaging device produces said virtual acoustic image on said display surface.

7. An audio-visual system in accordance with claim 6 wherein there are left channel, center channel, and right channel acoustic imaging devices for directing sound output toward a left portion, a central portion, and a right portion of said display surface respectively, to produce a virtual stereophonic acoustic image on said display surface.

8. An audio-visual system in accordance with claim 1, wherein said image production device comprises a high-definition television system, said display surface comprises a picture screen of said high-definition television system, and said acoustic image surface also comprises said picture screen of said high-definition television system.

9. An audio-visual system in accordance with claim 8 wherein there are left channel, center channel, and right channel acoustic imaging devices for directing sound output toward a left portion, a central portion, and a right portion of said picture screen respectively, to produce a virtual stereophonic acoustic image on said display surface.

* * * * *

UNITED STATES PATENT AND TRADEMARK OFFICE

CERTIFICATE OF CORRECTION

PATENT NO. : 5,210,802

DATED : May 11, 1993

INVENTOR(S) : J. Richard Aylward

It is certified that error appears in the above-indentified patent and that said Letters Patent is hereby corrected as shown below:

Column 2, line 10, "FIG." should be --FIG. 1--.

Signed and Sealed this

Thirty-first Day of May, 1994

Bruce Lehman

*Attest:*

BRUCE LEHMAN

*Attesting Officer*

*Commissioner of Patents and Trademarks*